United States Patent [19]

Hoffman et al.

[11] Patent Number: 5,055,317

[45] Date of Patent: Oct. 8, 1991

[54] METHOD FOR COATING ELONGATED WORKPIECES

[75] Inventors: Harry O. Hoffman, Youngstown; James E. Kalbes, Mineral Ridge; Mark A. Johnston, Youngstown, all of Ohio

[73] Assignees: Kathleen Hoffman; Harry O. Hoffman, both of Youngstown, Ohio

[21] Appl. No.: 372,767

[22] Filed: Jun. 29, 1989

[51] Int. Cl.[5] ..... B05D 3/00

[52] U.S. Cl. ..... 427/8; 427/282; 427/294; 427/424

[58] Field of Search ..... 427/8, 282, 294, 424

[56] References Cited

U.S. PATENT DOCUMENTS 4,762,727 8/1988 Voswinckel ..... 427/8

4,806,455 2/1989 LaBianca ..... 430/325

*Primary Examiner*—Bernard Pianalto

*Attorney, Agent, or Firm*—Clifford A. Poff

[57] ABSTRACT

Disclosed is a method for testing, adjusting and maintaining the viscosity of paint used in a vacuum applicator painting apparatus. By maintaining the paint viscosity within an optimum range, a layer of paint is applied to all surfaces and edges of workpieces to be painted is in a most economical, efficient and complete manner. Also disclosed is an improved painting apparatus of the vacuum applicator type for uniformly and efficiently painting large numbers of workpieces such as plywood boards.

11 Claims, 4 Drawing Sheets

METHOD FOR COATING ELONGATED WORKPIECES

This application is related to corresponding U.S. patent application Ser. No. 324,611 filed Mar. 17, 1989 and has a common assignee therewith.

BACKGROUND OF THE INVENTION

1. Field of the Invention

The present invention relates to coating methods and apparatus, in general, and to methods and apparatus for painting elongated workpieces such as boards, in particular. Even more specifically, the invention is directed to a method for maintaining an optimum range of paint viscosity in a paint which is applied to elongated plywood boards in a paint which is applied to elongated plywood boards as well as to a painting apparatus for painting such boards.

2. Description of the Prior Art

A variety of methods and apparatus are known for painting elongated workpieces such as boards. These methods range from hand painting of the boards with brushes, rollers and spraying devices which is acceptable when the size and/or number of boards to be painted is relatively limited, to automated roll, flow or spray coating machines and methods which are required when the size and/or number of the boards to be painted becomes substantial, i.e., in instances of mass production wherein large numbers of boards must be quickly and continuously painted. The present invention uses an improved version of what is known as a vacuum application technique for quickly and efficiently painting large numbers of boards, particularly plywood boards.

In the past, all automated techniques for painting large numbers of boards, including vacuum application techniques, suffered from being inefficient in their use of paint. For example, little regard or attention was given to continuous monitoring of paint viscosity, it being the single most important factor which must be optimized when one desires to efficiently and completely paint large numbers of objects in the most economical manner.

Paint viscosity is particularly sensitive to and is readily influenced by ambient climatic conditions such as temperature and humidity. As a general rule, the viscosity of a paint is inversely proportional to both temperature and humidity. For example, if either temperature or humidity increases, then viscosity decreases, and vice versa. This effect is compounded if both temperature and humidity simultaneously increase or decrease. If paint viscosity becomes too great, the paint may become excessively thick and therefore inefficiently applied to the workpiece to be painted, i.e., more paint than necessary will be used to coat the workpiece. Conversely, if paint viscosity becomes too low, the paint may become too thin, i.e., the paint may not completely cover the surface to be painted. Such a situation is at least as undesirable, if not more so, than the situation in which the paint viscosity is too great since the article to be painted will require at least two and possibly more painting treatments in order to completely cover the article. For obvious reasons, such repeated treatment of articles adversely affects mass production. Furthermore, repeated painting with too thin a paint may possibly require the use of more paint to cover the articles than the undesirable situation in which the paint is too thick.

An environment in which the efficient use of paint becomes critical, and to which the present invention is addressed, is the mass painting of the various surfaces of large numbers of plywood boards and the particular problems associated with painting the exposed edge portions of such boards. The unique qualities of the exposed edge portions of plywood boards present not only the usual paint coverage problems associated with paint viscosity discussed above, but still other problems which are not normally encountered when painting most other objects. As is known, plywood boards are formed of a plurality of relatively thin laminae of wood sheets which are bonded together in a stacked formation to form a board of any desired thickness. In order to enhance the strength of the plywood board, the laminae are so placed that the wood grain of each lamina extends perpendicularly to the wood grain of an adjacent lamina. For example, if the wood grain of a first lamina extends longitudinally of the length of the plywood board, then the wood grain of the second lamina will extend transversely of the length of the plywood board, and the wood grain of the third lamina will extend longitudinally of the length of the plywood board, etc. Thus, along the edges of the plywood boards there are exposed alternating layers of longitudinally extending wood grain and transversely extending "end-exposed" wood grain.

The direction of the exposed grain of a lamina is critical to the amount of paint which will be absorbed by that particular lamina when the edge portion of a plywood board is painted. For even if the various laminae which make up the plywood board are of the same type of wood, those laminae which have "end-exposed" or transversely extending wood grain will absorb significantly greater amounts of paint than those laminae having longitudinally extending wood grain. Thus, in painting the edge portions of plywood boards one must take into account the absorption characteristics of the alternating laminae and this, of course, affects the optimum paint viscosity which is selected for painting the plywood boards. In order to make efficient use of paint, one must therefore select and maintain an optimum range of paint viscosity. The paint cannot be too thin otherwise excessive amounts of paint will be absorbed into the "end-exposed" or transversely extending grained laminae at the exposed side edges of the plywood boards. Conversely, the paint cannot be too thick otherwise it too will be wastefully applied to the board. And, lastly, the paint viscosity should be so selected that it will permit the paint to efficiently yet completely cover the top and/or bottom surfaces of a plywood board, as well as the exposed edge portions, in a single pass of the board through a painting apparatus.

Of no less importance, the present invention is also directed toward an improved type of vacuum applicator coating or painting apparatus. Devices for coating workpieces "under vacuum" are known in the prior art. In the operation of such devices, paint or coating is pumped from a reservoir and then introduced into a workpiece application chamber in an atomized state. The interior of the application chamber is maintained under a negative pressure or vacuum. The vacuum serves to form a paint or coating "vapor environment" through which workpieces entering and exiting the application chamber must pass. Workpieces such as boards enter and exit the application chamber through spaced apertures in the chamber. A vacuum pump draws air through the entry and exit apertures of the chamber and the portion of the paint vapor in the chamber which is not applied to the workpieces is continuously recycled under the forces of the vacuum and gravity back to the paint reservoir. While such devices have generally provided a workable solution for mass painting of large numbers of objects such as boards, their design has disadvantageously located the position at which the atomized paint is introduced into the application chamber. The disadvantageous placement of the location at which the atomized paint is introduced into the chamber has produced a non-uniform "vapor environment" within the application chamber. Such a non-uniform vapor environment prevented some surfaces of a workpiece from being properly coated and further affected the uniformity of the coating thickness which was applied to a workpiece, i.e., the coating applied to a workpiece was often non-uniform in both thickness and consistency.

A further disadvantage in the design of prior art vacuum painting machines acts to compound the above-mentioned problems. As noted previously, the paint pumped to the application chamber is continuously recycled back to the reservoir. As the paint or coating is recycled back to the reservoir under the force of the vacuum, the paint must first pass through draining means located adjacent the sidewalls of the application chamber and which communicate with the bottom of the application chamber before reentering the reservoir. However, the atomized paint tends to condense during its passage through the draining means sites and then falls by gravity back into the reservoir in the form of liquid drops. As the liquid drops strike the paint in the reservoir, they produce an agitating effect in the paint which forms foam or bubbles therein. Such foam or bubbles, if left unchecked, tend to disperse throughout the paint in the reservoir and, with time, the entrapped air in the foam or bubbles becomes pumped, along with the paint, back into the vacuum application chamber. Such entrapped air thus causes discontinuities in the atomization of the paint in the application chamber. Since the paint is not consistently atomized in the chamber, the "vapor environment" in the chamber is non-uniform in consistency and thus the layer of paint which is applied to the board cannot be accurately controlled in thickness and consistency. The inconsistent atomization of the paint along with the disadvantageous location at which the atomized paint is introduced within the application chamber act in combination to provide an inconsistent "vapor environment" within the chamber. This inconsistent vapor environment thus applies a layer of paint to the board which is non-uniform in both thickness and consistency.

It is therefore an object of the invention to provide a method for maintaining an optimum range of paint viscosity of paint used in mass painting of plywood boards such that the paint will efficiently, economically and completely cover the top and/or bottom surfaces of a plywood board, as well as the exposed edge portions thereof, in a single pass through a painting apparatus.

It is further object of the invention to provide a method for adjusting the paint viscosity in response to climatic conditions such as temperature and humidity in order to obtain an optimum range of viscosity.

It is a further object of the invention to provide a method for testing the paint viscosity to determine if the paint has maintained or strayed from an optimum range of viscosity.

A still further object is to provide an improved and efficient vacuum applicator coating or painting apparatus which applies a layer of coating to an object which is uniform in both thickness and consistency.

Still other objects and advantages will become apparent when one considers the attached drawings and the description of the invention presented hereinbelow.

SUMMARY OF THE INVENTION

To overcome the problems of inefficient paint coverage of plywood boards which result from improper paint viscosity, there is provided a method for testing, adjusting and maintaining paint viscosity within an optimum range such that coverage of all exposed surfaces of plywood boards which are to be painted is performed in a complete and efficient manner. There is further provided an improved painting apparatus of the vacuum applicator type for uniformly and efficiently painting workpieces such as elongated plywood boards.

DESCRIPTION OF THE PREFERRED EMBODIMENT

Figure 1:
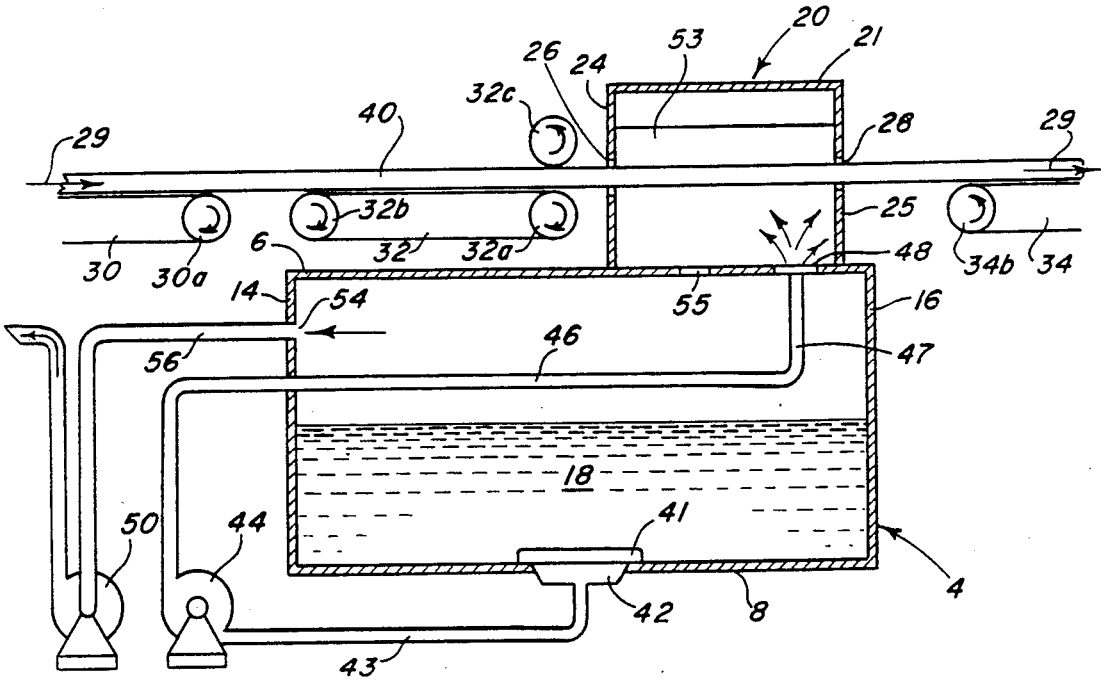
FIG. 1 (PRIOR ART)
FIG. 1 is a schematic side view of a prior art vacuum applicator coating apparatus.
Figure 1A:
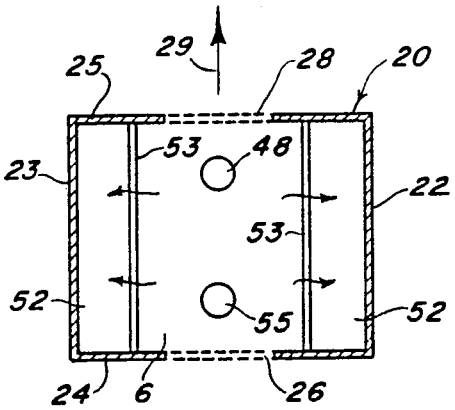
FIG. 1A (PRIOR ART)
FIG. 1A is a top view of the painting chamber of the vacuum applicator coating apparatus depicted in FIG. 1 with the top cover omitted for purposes of clarity.
Figure 1B:
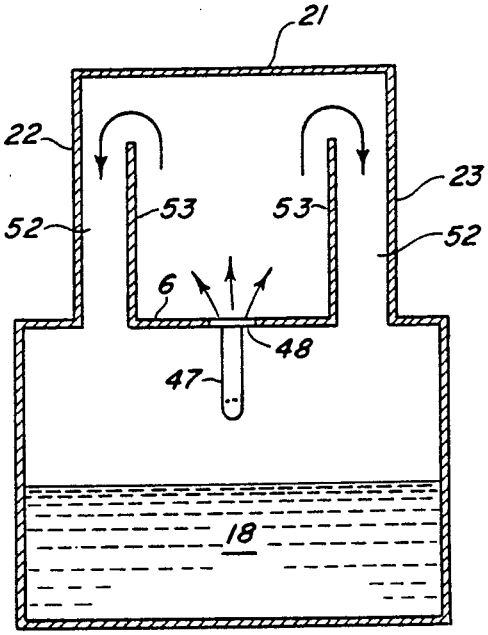
FIG. 1B (PRIOR ART)
FIG. 1B is a front view of the apparatus depicted in FIG. 1 with the front walls omitted for purposes of clarity.

At the outset, it is pointed out that elements in FIGS. 2, 3, 3A, 3B, 4A and 4B which are similar to those shown in FIGS. 1, 1A and 1B are designated with the same element numbers as their counterpart elements in FIGS. 1, 1A and 1B except that the corresponding element numbers of FIGS. 2, 3, 3A, 3B, 4A and 4B are further designated with prime symbols.

Depicted in FIG. 1 is a schematic view of a typical vacuum applicator painting or coating apparatus 2. The apparatus includes a paint or coating reservoir 4 having a top wall 6, a bottom wall 8 side walls 10 and 12, rear wall 14 and front wall 16. A volume of paint or coating 18 is contained within reservoir 4.

Mounted above reservoir 4 is a paint or coating application chamber 20. Chamber 20 is maintained under a negative pressure or vacuum as will be described hereinafter. Chamber 20 is formed by a removable top cover 21, side walls 22 and 23, rear wall 24, and front wall 25. The bottom edges of walls 22–25 are sealingly secured to top wall 6 of reservoir 4. The rear wall 24 and the front wall 25 of chamber 20 have formed therein apertures 26 and 28, respectively. An object to be painted passes through aperture 26, is painted in chamber 20 and exits the chamber through aperture 28. The means for transporting the object to be painted through the chamber 20 of vacuum applicator painting or coating apparatus 2 is a conventional conveyor system formed as a series of individual endless-belt type conveyors 30, 32 and 34. Forward rollers **30*a* and 32*a* of each of conveyors 30 and 32 are driven by suitable drive means such as motor 36 and gearing 38 shown in FIG. 2. The forward roller of conveyor 34, although not shown, is driven similarly to rollers 30*a* and 32*a* of conveyors 30 and 32**, respectively.

At the forward end of conveyor 32, located directly above drive roller **32*a*, is pinch roller 32*c*. As is conventional, pinch roller 32*c* is rotatably supported in a suitable guide frame structure (not shown) and is spring-biased downwardly and guided to be vertically reciprocable relative to driven roller 32*a*. Thus, as a workpiece such as a board 40 is transported along conveyor 32, it contacts pinch roller 32*c*, pushing roller 32*c* upwardly against the bias of its springs (not shown). Hence, the pinch roller 32*c* acts as a hold-down device to guide the workpieces through the aperture 26 of chamber 20. After the workpiece has traveled through chamber 20, it then encounters conveyor 34. At the rear of conveyor 34 is an idler roller 34*b* which is driven by the drive roller (not shown) at the forward end of conveyor 34 through an endless belt connecting the two rollers. And as can be appreciated, idler roller 32*b* of conveyor 32 and a similar idler roller (not shown) of conveyor 30** are driven in similar fashion through the drive connection between their respective endless belts and drive rollers.

Vacuum applicator painting or coating apparatus 2 is particularly well suited for continuously painting large numbers of elongated articles travelling therethrough. The elongated articles may be of any material of uniform dimension and substantial rigidity. The improved apparatus 2' of FIGS. 2 and 3 to which present invention is directed, as will be seen hereafter, is also particularly well suited to painting elongated articles such as boards, most particularly plywood boards.

Referring back to FIG. 1 an elongated object such as board 40 is shown being transported by conveyors 30, 32 and 34 through chamber 20. Paint or coating 18 for coating the board 40 is drawn through a filter screen 41 an then an opening 42 in bottom wall 8 of reservoir 4. The paint passes along line 43 and is then pumped by a pump 44 through a supply line 46 which connects to a coating or paint supply feed tube 47. Feed tube 47 terminates in a suitable diffusing means 48 which is located in the bottom of chamber 20. Diffusing means 48 serves to atomize the paint 18 as it is introduced into the chamber 20. The atomized paint creates a paint or coating "vapor environment" within chamber 20. As a board 40 passes through the vapor environment the board becomes coated by the atomized paint. Atomized paint within chamber 20 is constantly recycled back into reservoir 4 by a vacuum system described below.

A vacuum pump 50 draws in ambient air through entrance and exit apertures 26 and 28 of chamber 20. The influx of air through exit aperture 28 serves to assist in drying the board 40 as it exits the chamber. The vacuum created within chamber 20 by vacuum pump 50 induces a flow pattern in the atomized paint within the chamber as can be most clearly seen in FIGS. 1A and 1B. The atomized paint is thus drawn by the induced flow pattern to draining means such as draining passages 52 formed by two upstanding partitions 53 which are secured to the top wall 6 of reservoir 4 interiorly of chamber 20. As the atomized paint passes through the draining passages 52 it tends to condense and fall by gravity in the form of liquid drops into the liquid coating or paint 18 contained within reservoir 4. The air drawn in through apertures 26 and 28, however, passes through draining passages 52 and then through the space above the coating or paint 18 in reservoir 4, through a port 54 in the rear wall 14 of the reservoir, through a vacuum line 56 and then out of vacuum pump 50. Paint or coating pump 44 and vacuum pump 50 are continuously operated in order to achieve a continuously recycled "vapor environment" within the chamber. As will be discussed later, however, the vapor environment produced by the prior art vacuum applicator painting apparatus 2 shown in FIG. 1 does not produce a uniform or consistent thickness of coating on objects which are passed therethrough.

Also shown in FIGS. 1 and 1A is a drain hole 55 formed in top wall 6 of reservoir 4 interiorly of chamber 20 and between partitions 53. The purpose of drain hole 55 is to drain residual liquid paint contained between the upstanding partitions 53 when the vacuum pump 50 is shut off. When the vacuum pump 50 is operating, a pivotable cover member (not shown) is caused to close drain hole 55. When the vacuum pump 50 is not operating the pivotable cover member opens drain hole 55 to permit the residual liquid paint to drain into reservoir 4.

The improved vacuum applicator painting apparatus 2' of the present invention is shown in FIGS. 2, 3, 3A, 3B, 4A and 4B. Elements common to all of the figures which were previously discussed with reference to FIGS. 1, 1A and 1B will not be described in further detail in the descriptions of FIGS. 2, 3, 3A, 4A, and 4B except when necessary. As will become apparent, the vacuum applicator painting apparatus 2' of the present invention provides a number of substantial improvements over the prior art.

Figure 2:
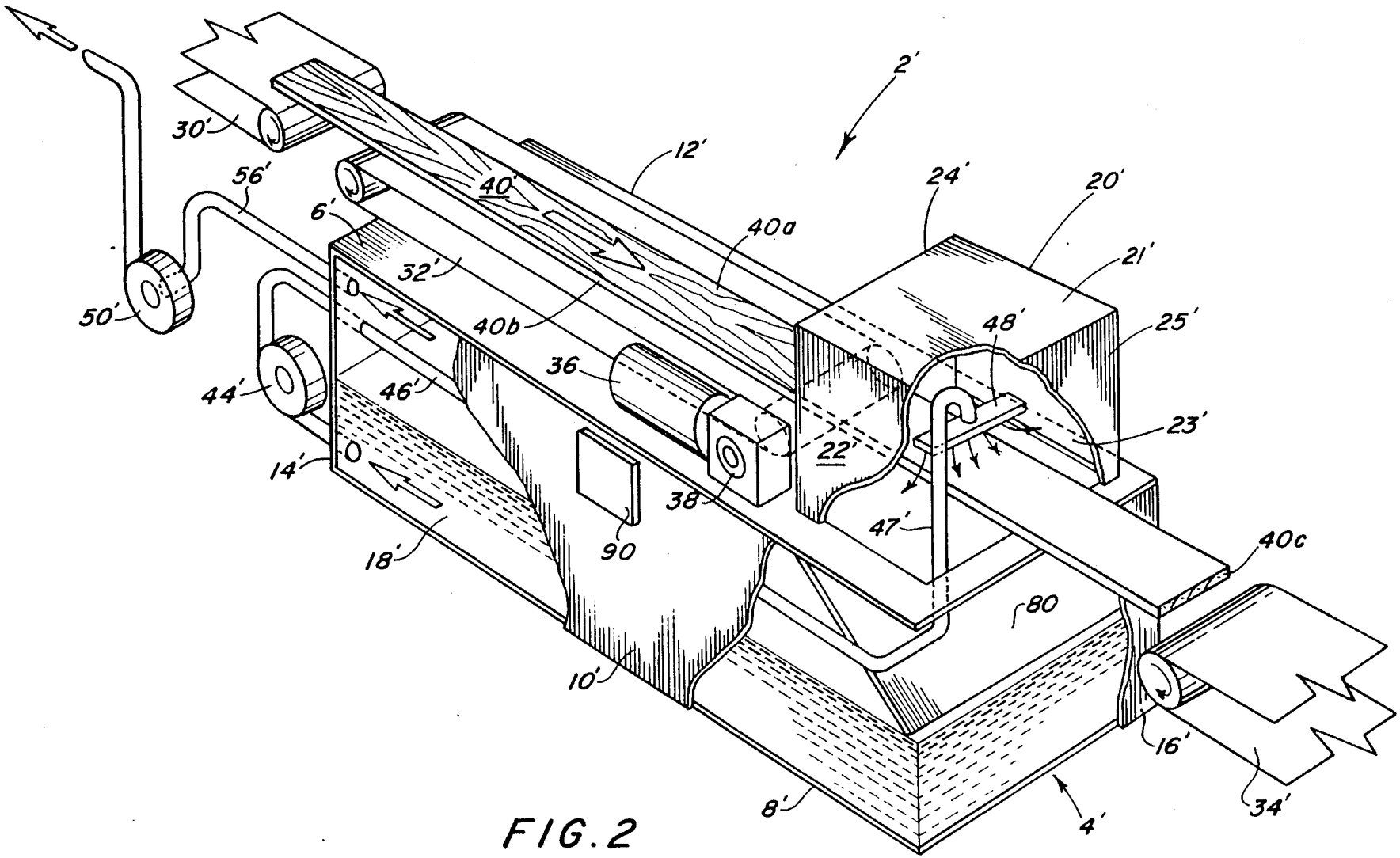
FIG. 2 is a partially-cut perspective view of an improved vacuum applicator coating apparatus constructed in accordance with the present invention with some elements not shown for purposes of clarity.
Figure 3:
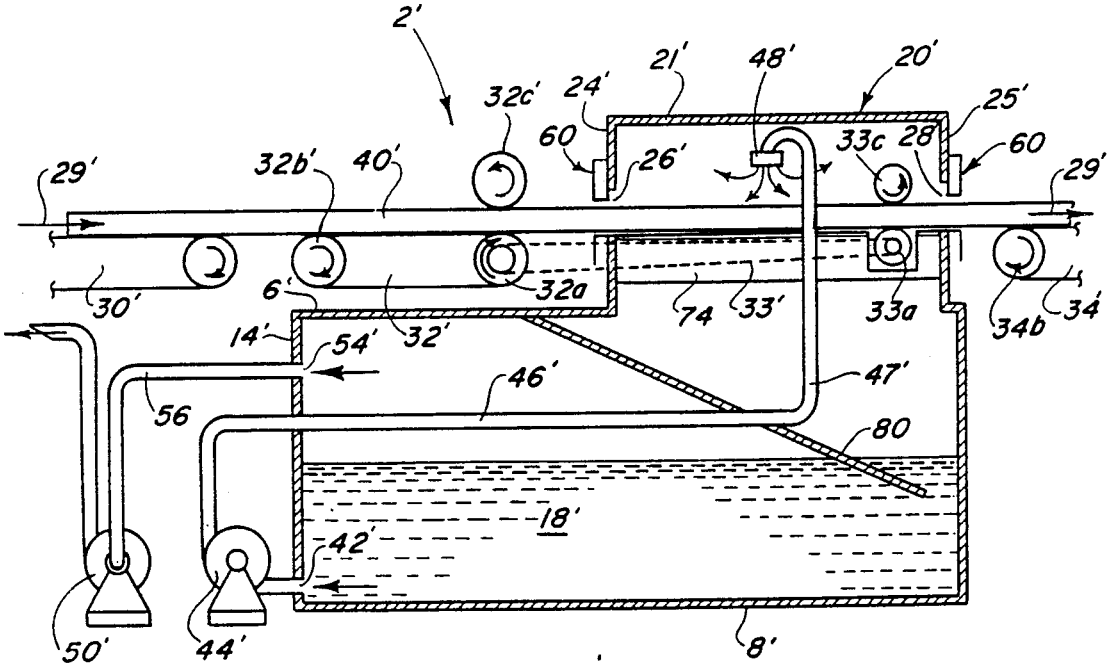
FIG. 3 is a schematic side view of the apparatus of FIG. 2.

As can be seen in FIG. 3, there is provided a side schematic view of improved vacuum applicator painting apparatus 2' constructed in accordance with the present invention. Like the apparatus 2 shown in FIG. 1, the painting apparatus 2' depicted in FIGS. 2 and 3 also includes a guide/hold-down system for the workpieces or boards as they are conveyed by the conveyors. As is well known, it is common for elongated boards to be warped along their lengths. For this reason the prior art painting apparatus 2 has been known to jam when somewhat overly-wrapped boards are passed therethrough. When such boards are guided into the chamber 20 by pinch roller **32*c*, they subsequently become misaligned at the forwardmost ends thereof and fail to pass through exit aperture 28 in the front wall 25 of the chamber and thus become jammed up against the interior surface front wall 25**. The misalignment of the front ends of such boards is caused by a lack of hold-down and guidance support for the boards as they pass through the chamber.

The present invention provides a system for guiding and positively supporting all boards, including overly-warped boards, as they pass through the application chamber 20' in order to avoid jam-up of the boards within the chamber. The avoidance of such jam-ups thus prevents the often frequent shutdown of the machine required in order to clear the jammed boards.

As can be seen in FIG. 3, along with the exterior drive roller 32*a*′ and pinch roller 32*c*′, the present invention also provides a drive roller 33*a* and pinch roller 33*c* within the chamber 20′ adjacent the exit aperture 28′. Pinch roller 33*c* is spring biased and guided for vertical reciprocation in virtually the same manner as pinch roller 32*c* previously discussed with regard to FIG. 1. It is also advantageous to positively drive roller 33*a* using a positive drive connection between its axle and the axle of exterior drive roller 32*a*′. Such a connection is provided by an endless transmission means 33′, such as a belt or a chain depicted in dashed lines in FIG. 3, which drivingly connects either pulleys or sprockets attached to the shafts of rollers 32*a*′ and 33*c*. Therefore, by driving roller 32*a*′, the endless transmission means 33′ connected thereto also positively drives roller 33*a*. It should also be noted that in order to avoid cluttering of the interior of chamber 20′, the sprocket or pulleys attached to the axles of rollers 32*a*′ and 33*a*, as well as the endless transmission means 33′, are located exteriorly of chamber 20′. Also, it is preferred that the drive roller 33*a* be formed as a series of spaced disks and that the pinch roller 33 be a cylinder. If formed as a cylinder, the pinch roller 33*c* not only acts as an interior guide or hold-down for the board as it passes through chamber 20′, but is also acts as a squeegee device for wiping the board in order to prevent excess paint from being expelled from the chamber as the board exits the chamber. The pinch roller 33*c* may be formed of steel or other suitable material. And, the spring biasing force applied to all of the pinch rollers is preferably adjustable to compensate for varying load requirements, i.e., variable warpage of the boards.

In operation, a board is fed into the chamber 20′ by conveyor segment 32. The pinch roller 32*c*′ holds the board down and guides the front of the board into the chamber through entrance aperture 26′. If the board is somewhat warped, the front end thereof may become misaligned as it approaches the exit aperture 28′. If so, the front end of the board will contact the drive roller 33*a* and/or the pinch roller 33*c* within the chamber, become properly realigned between the rollers, and then pass through exit aperture 28′ in proper alignment therewith. Furthermore, the outer diameters of drive roller 33*a* and pinch roller 33*c* are dimensioned to be as small and as unobtrusive as possible so that their size does not affect the uniformity of the "vapor environment" within the chamber.

Figure 4A:
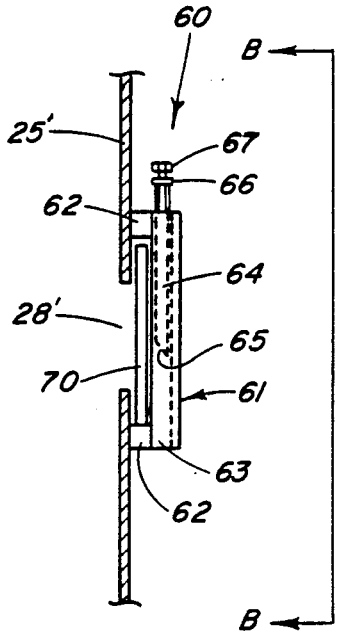
FIG. 4A is an enlarged side view of the preferred baffle means for use with the vacuum applicator coating apparatus of the present invention with some elements omitted for purposes of clarity.
Figure 4B:
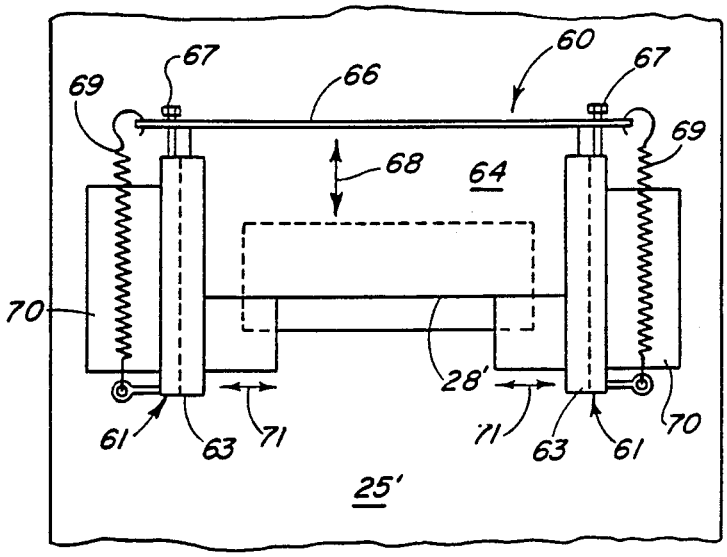
FIG. 4B is a front view of the baffle means depicted in FIG. 4A.

Another contemplated embodiment of a means for holding down and guiding a board through exit aperture 28′ is depicted in FIGS. 4 and 4A which show a hold-down and guide means 35. Hold-down and guide means 35 includes three threaded rods 35*a* which are threadably and adjustably received in removable top cover 21′. Vertical adjustment of threaded rods is achieved by selectively rotating knobs 35*b* which are fixed to the tops of rods 35*a*. Threadably received on an intermediate portion of each rod 35*a* is a nut 35*c*. The bottom of portion of each rod 35*a* passes through a bracket 35*d* and is retained therein by a fastener such as cotter pin 35*e*.

Each bracket 35*d* is fixed, as by welding for example, to a T-shaped plate 37 with one bracket 35*d* welded to the rear of the leg of the T-shaped plate 37 and the other two brackets 35*d* welded to opposite ends of the cross-bar of T-shaped plate 37. Provided between the lower surface of each nut 35*c* and the upper surface of each bracket 35*d* is a compression spring 35*f*. Adjustment of the nuts 35*c*, therefore, serves to adjust the biasing force which springs 35*f* exert downwardly on T-shaped plate 37 and, thus, the board passing thereunder in the direction of arrow 29′.

In order to assure positive passage of the end of a warped board under plate 37, it is suggested that the threaded rod 35*a* which is used for vertically adjusting the leg of the T-shaped member 37 be raised somewhat higher in elevation than the threaded rods which vertically adjust the cross-bar portion of the T-shaped plate so that the rear of T-shaped plate 37 is angled slightly upwardly relative to the front thereof. The adjustable structure of hold-down and guide means 35, as can be appreciated, permit boards of a wide range of thicknesses to be held-down and guided through exit aperture 28′. Lastly, welded to the forwardmost end of the cross-bar of T-shaped plate 37 are a series of spaced L-shaped brackets 39 whose lowermost board-contacting edges 39*a* introduce a slight spacing between the bottom surface of the cross-bar of T-shaped plate 37 and the portion of the board passing thereunder. Such slight spacing reduces smearing of the paint on the board which might be caused by contact between the painted surface of the board and the lower surface of T-shaped plate 37.

With either hold-down and guide means construction, i.e., pinch roller or adjustable rods, it becomes apparent that the undesirable jamming of boards within the paint application chamber can be virtually eliminated as well as the maintenance operations associated therewith. Therefore, an efficient and continuous workpiece painting operation is achieved.

Referring again to the prior art vacuum applicator painting apparatus 2 illustrated in FIG. 1, it can be seen, as was previously noted, that the diffusing means 48 introduces atomized paint into the bottom of the chamber 20. This particular location of diffusing means 48 does not permit the atomized paint to be uniformly distributed throughout the chamber 20—especially when under the influence of the vacuum. Atomized paint introduced from such a low elevation in the chamber causes the concentration of atomized paint to be significantly greater at lower regions of the chamber than at upper regions thereof. This undesirable situation is further enhanced by the location of draining passages 52 in the chamber 20. When under vacuum, the majority of the mass of atomized paint is circulated beneath and alongside the object to be coated with only small portions of the mass of the paint reaching upper central regions of the chamber. In other words, the majority of the atomized paint tends to flow from the diffusing means 48 along the vertical surfaces of partitions 53 and virtually directly to draining passages 52. Such a flow permits an undersurface of a workpiece to be sufficiently covered while the upper surface of the workpiece is inconsistently or extremely thinly covered due to the lack of a sufficient mass of atomized paint in the upper central regions of the chamber.

The design of the present invention, however, provides uniform and consistent distribution of atomized paint throughout the paint or coating application chamber. A notable difference between FIG. 1 in FIGS. 2 and 3 extends well up into the upper region of chamber 20′ while its counterpart feed tube 47 in FIG. 1 extends only to the bottom surface of the chamber 20. By extending feed tube 47' into an uppermost region of chamber 20', the diffusing means 48' at the discharge end of the feed tube 47' permits the atomized paint to be introduced into upper regions of the chamber above the object to be painted. And, when under vacuum, the atomized paint introduced at such a location becomes uniformly dispersed throughout the chamber 20' as it is circulated downwardly through the chamber by the forces of gravity and suction.

Two other features of the present invention further enhance the creation of a uniform "vapor environment" throughout chamber 21.

First, the upstanding partitions 53 and the portions of the top wall 6 of reservoir 4 supporting the partitions 53 are eliminated in the design of the present invention. The removal of such structure advantageously eliminates concentrated flow path regions such as draining passages 52 which are inherently created by the inclusion of partitions 53. By the elimination of such concentrated flow path regions, the atomized paint is permitted to disperse evenly throughout the chamber 20 so as to pass uniformly through the virtually completely open bottom area of chamber 20 into reservoir 4.

Second, the diffusing means 48' of the present invention is preferably elongated to extend substantially entirely across chamber 20 between side walls 22' and 23'. The diffusing means 48 of the prior art, on the other hand, is relatively small, circular and centrally located within chamber 20. As can be readily appreciated, the increased diffusion surface area as well as the lateral range provided by the diffusing means 48' of the present invention further serve to enhance the uniform dispersion of atomized paint throughout the chamber 20 to a degree heretofore not attainable by the diffusing means 48 of the prior art. Thus, all surfaces of the objects 40' which are introduced into chamber 20' are provided with a layer of coating which is uniform in both thickness and consistency due to the uniform "vapor environment" throughout chamber 20' which is created by the unique construction of the present invention.

Figure 3A:
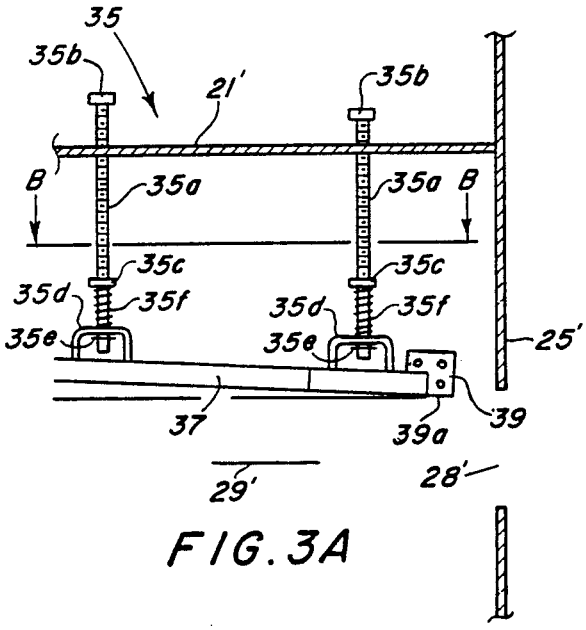
FIG. 3A is an enlarged side view of an alternative embodiment of workpiece hold-down and guiding means which are used in the interior of the coating application chamber of the vacuum applicator coating apparatus of the present invention.
Figure 3B:
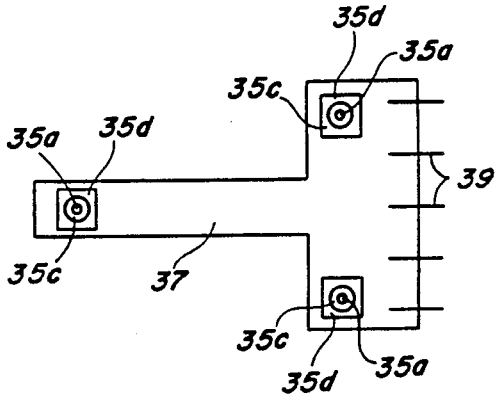
FIG. 3B is a view as seen along line B-B of FIG. 3A.

Referring still to FIG. 3 and also to FIGS. 3A and 3B there can be seen a further advantage provided by the structure of the present invention.

Secured to the exterior surfaces of rear wall 24' and front wall 25' of chamber 20' are upstanding baffle means 60. The purpose of baffle means 60 is to at all times maintain a significant vacuum force in the chamber 20' by limiting the space around the boards or workpieces through which ambient air is drawn in via apertures 26' and 28' by vacuum pump 50' during operation of the painting apparatus 2'. By maintaining a relatively small clearance between the outer periphery of the boards 40' and the inner periphery of the baffle means 60, a positive vacuum, or negative pressure, is maintained in the chamber 20' during operation of the painting apparatus.

The structure of baffle means 60 which is attached to the front wall 25' of chamber 20' is illustrated in FIGS. 3A and **3*b* and will be described in detail hereinbelow. However, as should be appreciated, the description of the baffle means 60 attached to front wall 25' also applies to the description of the baffle means 60 attached to rear wall 24'**.

Baffle means 60 includes a pair of vertically-oriented nylon guide tracks 61 which are secured on opposite sides of aperture 28'. Suitable fastening means (not shown) pass through guide tracks 61 and through upper and lower spacing means 62 to secure the guide tracks 61 to wall 25'. Each guide track 61 has formed therein a vertical groove 63 which is open in the direction of aperture 28'. Slidably, adjustably and removably received in opposed grooves 63 is a nylon baffle gate member 64. Baffle gate member 64 is provided at its lower most end with a surface 65 which is bevelled upwardly and inwardly toward the interior of chamber 25. The surface 65 is upwardly and inwardly beveled in order to direct a significant portion of the air drawn in through aperture 28' into upper regions of chamber 20' so as to enhance the dispersion of the atomized paint and also so that the gate member 64 may be relatively easily raised when contacted by the leading edge of a somewhat warped board so as to permit relatively resistance-free passage thereof out of aperture 28'. The provision of such a beveled surface 65 on the gate member 64 of the baffle means 60 which are secured to front wall 24' is optional since the bias on roller **32*c*' is of such a magnitude that even relatively severely warped boards can be passed through the predetermined space below the gate 64** without contacting the gate.

Secured along the upper surface of baffle gate 64 is a plate 66 having threaded apertures (not shown) formed near opposite ends thereof for threadably receiving threaded adjustment members such as bolts 67. The bottoms of bolts 67 contact the top surfaces of guide tracks 61. As can now be readily seen, the baffle plate 64 is simply slid into the grooves 63 formed in guide tracks 61 until the bottoms of bolts 67 contact the top surfaces of guide tracks 61. Thereafter, the bolts 67 are turned in the appropriate direction in order to raise or lower the baffle plate 64 in the directions indicated by arrow 68. With such an adjustment system a wide range of thicknesses of boards may be effectively treated in chamber 20'. One of a pair of springs 69 is releasably attachable to a hole provided in each end of plate 66 and extends downwardly to where it is attached to an eye hook or the like which extends from near the bottom of a respective guide track 61.

Springs 69 serve to resist upward displacement of baffle plate 64 caused by the passage of a warped board through aperture 28'. By resisting such upward displacement of the baffle plate 64, the springs 69 assist in maintaining the small clearance of baffle means about the periphery of the board and, hence, the suction within the chamber 20'. In order to remove baffle plate 64, springs 69 are detached from the ends of plate 66 and the baffle plate is then slid out of nylon guide tracks 61.

Lateral adjustment of the clearance provided by baffle means 60 along the sides of boards passing through aperture 28' is provided by an opposed pair of laterally slidable and removable baffle plates 70. Baffle plates 70 are slid into and out of spaces formed behind the nylon guide tracks 61 and between upper and lower spacing means 62. Baffle plates 70 are slid in the directions indicated by arrows 71 in order to create and maintain a relatively small clearance between themselves and the side edges of the boards passing through the chamber 20' to assist baffle plate 64 in maintaining the positive vacuum within chamber 20'. Clearly, such an arrangement, in combination with the vertically adjustable baffle plate 64 permits simple, quickly adjustable, and effective accommodation of a wide range of widths and thicknesses of boards which may be treated in chamber 20'.

Another advantageous feature of the present invention is seen in FIG. 3. It may not always be necessary or even desirable to coat all the surfaces of an object such as board 40' as it passes through chamber 20'. This being the case, the interior of chamber 20' may be provided with one or more removable masking means such as spaced angle members 74. The forward portions of the opposed downwardly-directed sections of angle members 74 are notched to receive roller 33*a* therethrough. The downwardly-directed portions of the spaced angle members 74 are selected to be of such a height so as to preclude paint vapor from rising upwardly therebetween to coat the bottom of boards 40'. Also, it is contemplated that the masking means 74 may be a simple plate which is dimensioned to be just slightly wider than the surface of the board which it is to shield from paint. It is to be understood that masking means show in FIG. 3, while illustrated as a masking means for the bottom surface of the board 40', may be so positioned in the interior of the chamber as to mask the upper surface 40*a* of the board.

As a practical example, if one wished to paint housing or building trim boards, one would only need to paint the front surface and the two side edges of the boards since these are the only surfaces which can be seen when the trim boards are attached to a house structure.

Therefore, one would most advantageously provide a removable masking means such as masking means 74 which would extend substantially the entire length of the chamber 20' at an elevation just below where the lower surfaces of the boards 40' will pass through the chamber.

In such a position, the masking means 74 acts not only as a masking means to prevent paint from coating the lower surface of the board 40' but it also acts as a secondary guide member for the boards, particularly warped boards, as they pass through the chamber 20'.

Suitable means for supporting the masking means 74 in chamber 20' may include upstanding supports or other supporting means such as spaced, parallel, horizontal rods which would be supported in side walls 22' and 23' of chamber 20'.

Still another important feature of the present invention is clearly illustrated in FIGS. 2 and 3. In these figures, there can be seen a downwardly directed and inclined plate member 80 attached to and depending from an undersurface of the top wall 6' of reservoir 4'. The member 80 is secured to the undersurface of top wall 6' just rearwardly of the coating chamber opening provided in the top wall 6'. As noted previously, in the normal operation of such vacuum application painting devices, including that of the present invention, the atomized paint which is drawn downwardly by vacuum thereafter falls by gravity in the form of liquid drops into the liquid paint in the reservoir. In the prior art device shown in FIG. 1, these falling paint drops produce an agitating effect in the paint which forms foam or bubbles therein. Such foam or bubbles, if left unchecked, tend to disperse throughout the paint in the reservoir and, with time, the entrapped air in the foam or bubbles becomes pumped, along with the paint, back into the vacuum application chamber. Such entrapped air thus causes an inconsistency in the paint as it is atomized in the application chamber. Since the paint is not consistently atomized in the chamber, the "vapor environment" in the chamber is non-uniform in consistency and thus the layer of paint which is applied to the board cannot be accurately controlled in thickness and consistency.

The presence of member 80 completely eliminates the deleterious effects resulting from foaming of the paint in the reservoir caused by liquid drops falling into the paint. As can be seen in the unique construction of the present invention depicted in FIGS. 2 and 3, when the liquid drops of paint fall from chamber 20' through the opening provided in the top wall 6' they strike inclined member 80 and thereafter flow harmlessly down the slope of the member 80' and gently reenter the liquid 18' without agitating the paint and causing foam or bubbles therein. Thus, the paint 18' which is pumped by pump 44' is at all times bubble-free. Therefore, the paint is consistently and uniformly atomized as it exits diffusing means 48' in chamber 20'.

The provision of member 80, along with the placement of the diffusing means 48' in the uppermost region of chamber 20', inter alia, further ensures that at all times the dispersion of atomized paint throughout the chamber 20' is uniform and consistent. Such uniformity and consistency of the atomized paint vapor thus permits a uniform, consistent and easily controllable thickness of coating layer to be applied to all surfaces of the object intended to be coated. However, while member 80 is an advantageous feature of the invention, it may be omitted if desired.

A unique disadvantage resulting from the operation of vacuum applicator devices is that the viscosity of the paint used therein is particularly sensitive to and readily influenced by ambient climatic conditions such as temperature and humidity. Since outside air is continuously drawn into the vacuum application chamber during the operation of such devices, heat (or coldness) and moisture of the air continuously affects the viscosity of the atomized paint in the chamber and ultimately the viscosity of the paint within the reservoir. And, if the air being drawn in is relatively high in both temperature and humidity, the viscosity of the paint accordingly will be reduced with time. Conversely, if the air being drawn in is cool and dry, the viscosity will increase with time. Appropriate measures to compensate for such varying paint viscosity must therefore be provided.

As previously noted, a particular preferred use of the improved vacuum applicator painting apparatus of the present invention is in the painting of plywood boards. And, the problems associated with efficiently economically and yet completely coating the various surfaces and edges of such boards has been previously discussed in great detail hereinabove. Through experimentation, it has been determined that an optimum range of paint viscosity exists which is most effective in completely yet economically covering all surfaces and edges of plywood boards, regardless of the types of wood used to form the boards.

To determine if the paint viscosity is within the optimum paint viscosity range, a standard volume sample of paint is periodically taken from the paint reservoir and tested. The paint sample may be obtained through hatch 90, for example. This hatch and others may be provided in the reservoir 4' for taking the sample, filling the reservoir, maintaining the reservoir and the contents thereof, etc. The testing of the paint sample involves observing and recording the flow time required by the sample to pass through a No. 2 Zahn cup at 65° F. It has been determined that the optimum range of paint viscosity corresponds to a flow time of between 22 to 23 seconds for the standard volume sample to pass through the No. 2 Zahn cup. If the standard volume paint sample requires less than 22 seconds to flow through the No. 2 Zahn cup, then the paint is too thin and an amount of paint must be added to the reservoir in order to increase the concentration of paint therein. Conversely, if the standard volume paint sample requires more than 23 seconds to flow through the No. 2 Zahn cup, then the paint is too thick and an amount of water must be added to the reservoir in order to decrease the concentration of paint therein. The volume of paint of water to be added to the reservoir depends on a number of factors including:

(1) current temperature and humidity, (2) projected short-term future temperature and humidity (i.e. within approximately 2–6 hours from the present), and (3) the volume of paint currently in the reservoir.

It has been found to be most useful to develop tabular historical data for determining the volume of paint or water to be added to the reservoir as a function of the above-mentioned factors. Thus, once one determines the current viscosity of the paint using the No. 2 Zahn cup viscosity test, one can then refer to the historical tabular data for then determining the exact amount of paint of water to be added to the reservoir in order to obtain the optimum range of paint viscosity.

As can be readily appreciated, ambient temperature and humidity may dramatically fluctuate from day-today and even hour-to-hour. Therefore, it is suggested that in order to maintain the optimum range of viscosity of the paint in the reservoir, the paint should be tested using the No. 2 Zahn cup viscosity test at least at the start of each operation working shift of the vacuum applicator painting device and, preferably, one or more additional times during each working shift. By frequently testing the paint in the reservoir, the viscosity thereof is substantially continuously monitored and/or adjusted so that the optimum range of viscosity is maintained. And, if the optimum range of paint viscosity is so maintained, then the vacuum applicator painting device of the present invention will efficiently, economically and completely apply to all surfaces and edges of plywood boards passing therethrough a layer of paint which is uniform in thickness and consistency.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

We claim:

1. A method for coating a workpiece in a vacuum applicator coating device of the type having a coating material receiving reservoir and a fluid coating application vacuum chamber through which a workpiece advances in a generally horizontal direction therethrough, said chamber being mounted above and in fluid communication with said reservoir, said coating device further including means for delivering the coating material from said reservoir to said chamber, means for introducing the coating material in an atomized state into said chamber, and means for maintaining a vacuum in said chamber, said method comprising:

passing a workpiece in said horizontal direction through said chamber;

coating a workpiece within said chamber by introducing atomized coating material into an upper region of said chamber and above an advancing workpiece such that the introduction of said atomized coating material into the upper region of said chamber and above a workpiece permits a substantially uniform and consistent coating vapor environment to be created in substantially all regions of the chamber so that a workpiece advancing through said chamber will be provided with a layer of coating which is substantially uniform in thickness and consistency, and monitoring the viscosity of the coating material in said reservoir in response to temperature and humidity climatic factors affecting the coating material and adjusting the viscosity to maintain the viscosity in an optimum range.

2. The method of claim 1 wherein said maintaining an optimum viscosity range in the coating material comprises:

removing a sample of the coating material from the reservoir;

testing the viscosity of the removed sample; and adjusting the concentration of the coating material in the reservoir by adding an amount of one of either said coating material or a thinning material to the reservoir in response to viscosity data obtained from said testing of the viscosity of the removed sample.

3. The method of claim 2 wherein, in further response to the viscosity data obtained from said testing of the viscosity of the removed sample, the step of adjusting the concentration of the coating material further comprises determining from historical data the amount of the coating material or the thinning material to be added to maintain said optimum viscosity range.

4. The method of claim 1 further comprising providing removable masking means within said chamber, said masking means serving to prevent at least one surface of a workpiece from being coated as the workpiece passes through said chamber.

5. The method of claim 1, wherein said chamber includes means for recycling the coating material from said chamber back to said reservoir and said method further comprising collecting and directing condensed portions of said atomized coating material during said recycling in a manner that said condensed portions will pass gently from said chamber to said reservoir thereby preventing substantial agitation and associated entrapment of air in the coating material in said reservoir the coating material falling by gravity in the form of liquid drops and striking the coating material in said reservoir.

6. The method of claim 5 wherein the step of collecting and directing comprises providing downwardly inclined plate means to extend beneath said chamber to receive and direct said condensed portions of said atomized coating material impinging thereupon to flow therealong and pass gently into the coating material in said reservoir.

7. The method of claim 1 wherein said coating device includes an exit aperture for the workpiece, the further step of guiding the workpiece through said exit aperture with guide means positioned with said chamber.

8. The method of claim 7 wherein step of guiding further comprises applying a biasing force against the workpiece to hold-down the workpiece during passage thereof through said exit aperture.

9. The method of claim 7 wherein said coating device includes an entrance aperture for the workpiece, the further step of adjustably baffling the space surrounding the periphery of the workpiece as it passes through said entrance and exit apertures.

10. The method of claim 1 further comprising the step of substantially eliminating entrapped air from the coating material in the coating reservoir.

11. The method of claim 10 wherein said step of substantially eliminating entrapped air comprises directing condensed portions of said atomized coating material to pass gently from the chamber to the reservoir thereby preventing agitation and associated entrapment of air in the coating material in the reservoir caused by said condensed portions of said coating material falling by gravity in the form of liquid drops and striking the coating material in the reservoir.

* * * * *